US006129088A

United States Patent [19]

Favre

[11] Patent Number: 6,129,088

[45] Date of Patent: Oct. 10, 2000

[54] CASE WITH A DISENGAGEABLE HINGE AND AN AUTOMATICALLY MATING LIP

[75] Inventor: Bernard Favre, Chevilly-Larue, France

[73] Assignee: Lir France, Chevilly-Larue, France

[21] Appl. No.: 09/132,538

[22] Filed: Aug. 11, 1998

[30] Foreign Application Priority Data

Aug. 11, 1997 [FR] France ..... 97 10255

[51] Int. Cl.[7] ..... A45D 33/00

[52] U.S. Cl. ..... 132/293; 132/294; 206/DIG. 26

[58] Field of Search ..... 132/293, 294, 132/295, 298, 299, 300, 303; 220/233, 526; 206/DIG. 26, 235, 581, 823

[56] References Cited

U.S. PATENT DOCUMENTS 5,542,561 8/1996 Slink et al. ..... 132/293
5,906,212 5/1999 Favre ..... 132/300

*Primary Examiner*—Pedro Philogene
*Attorney, Agent, or Firm*—Nawrocki, Rooney & Sivertson, P.A.

[57] ABSTRACT

A cosmetic case having an opening which is covered by a hinged pivotable lid which can pivot from a position where the case opening is exposed, to a position where the lid completely covers the opening and provides a sealed enclosure for cosmetics. A two part latching apparatus attached to the lid and case automatically latches the two together whenever the lid is closed. This two part latching apparatus utilizes complementary latching members which mate with and automatically engage each other.

50 Claims, 5 Drawing Sheets

CASE WITH A DISENGAGEABLE HINGE AND AN AUTOMATICALLY MATING LIP

BACKGROUND OF THE INVENTION

1. Field of the Invention

The invention concerns a case, particularly intended to receive a cosmetic such as make-up, the powder compact formed from such a case and a method of opening and a method of closing the case.

2. Background

A case is known comprising:

a hollow base, provided with
- a transverse wall;
- a first wall of roughly cylindrical shape with respect to a principal axis of the case, defining, with the transverse wall, a compartment (6) , notably for make-up, a hollow lid, provided with
- a transverse wall,
- a first wall of roughly cylindrical shape with respect to the principal axis of the case;

means forming a hinge around a second axis orthogonal to the principal axis at the periphery of the first walls, and comprising
- a first hinge part, associated with the base,
- a second hinge part, associated with the lid, complementary to the first hinge part, the lid and base being able to be situated, with respect to each other, between two extreme positions:
- a latched closure position, in which the base and lid are rigidly associated with each other opposite each other,
- a complete opening position, in which the lid allows access to the compartment in the base, the lid and base being able to pass from one to another of the complete opening and latched closure positions, this passage entailing at least a tilting of the lid with respect to the base about the second axis, complementary latching members, respectively for the base and for the lid, which, when they are in mutual engagement, enable the lid to be in the latched closure position and which, when they are mutually disengaged, enable the lid to be brought to and be situated in the complete opening position, one of the first cylindrical walls of the base or of the lid surrounding the other first cylindrical wall of the lid or base, in the latched closure position, the base and lid having complementary sealing members, able, when the lid is in the latched closure position, to be applied against each other in order to seal the compartment.

It is known that the compartment intended to contain the make-up can be sealed by means of a sealing joint.

However, this joint is attached to the lid or to the base, which requires it to be fixed in advance as a supplementary piece to a part of the case.

It is therefore wished to dispense with an attached joint, as a sealing member.

In order to provide a seal between two pieces, it is known that an automatically mating lip between them can be used.

The automatically mating lip must be applied laterally by one of its faces to a parallel face on the opposite piece, in order to provide the seal.

SUMMARY OF THE INVENTION

The invention relates to a case providing both a seal for the cosmetic which it contains by means of an automatically mating lip and easy passage from one to the other of the latched closure and complete opening positions.

The invention provides that:

The lid and base can be situated with respect to each other in an intermediate engagement position in which:
- the complementary latching members are mutually disengaged, and
- the first part of the hinge cooperates with the second part of the hinge, allowing pivoting about the second pivot axis, the base and lid have members for mutual guidance in translation along the principal axis of the case and members for mutual guidance on this axis, on the faces of their cylindrical walls turned towards each other, the sealing members comprising at least one automatically mating lip, on the lid, able to be applied sealingly to a part of the base, forming a complementary sealing member, the automatically mating lip being:
- in the latched closure position, applied sealingly to the said part of the base,
- disengaged from this part, in the position of engagement and complete opening of the lid and base, the first and second hinge parts are such that, essentially by rotation from the engagement position on the principal axis (5) of the case by the means of mutual guidance in rotation, the first part of the hinge is disengaged from the second part of the hinge, the first and second hinge parts:
- being disengaged from each other in the latched closure position,
- cooperating in the complete opening position, the lid and base being able to pass from one to the other of the complete opening and intermediate engagement positions, by pivoting of the second hinge part (11) with respect to the first hinge part (10), about the second axis, the lid and base being able to pass from one to the other of the latched closure and intermediate engagement positions, by rotating the lid with respect to the base about the principal axis of the case using the members for mutual guidance in rotation, and by moving the lid in translation with respect to the base on the principal axis of the case using the members for mutual guidance in translation.

The invention makes the presence of an automatically mating lip in the case, as a sealing member, compatible with the pivoting movement of the lid about the second axis, necessary for opening and closing the case.

The invention also provides a case, in which:

one of the hinge parts comprises at least one pivoting stud, directed along the second axis and in a first direction of rotation with respect to the principal axis of the case, and the other hinge part has at least one recess, turned towards the pivoting stud and able to receive it, the base and lid have members for mutual guidance in rotation about the principal axis of the case on the faces of their cylindrical walls turned towards each other, the lid and base can be situated, with respect to each other, in an intermediate engagement position, in which
- on the one hand, the complementary latching members are mutually disengaged, and
- on the other hand, the pivoting stud is engaged in the recess, allowing pivoting about the second axis, the pivoting stud being:

in the complete opening position, engaged in the recess, allowing pivoting about the axis, in the latched closure position, disengaged from the recess, the lid and base being able to pass between one and the other of the complete opening and intermediate engagement positions, by pivoting of the pivoting stud in the recess about the second axis, the lid and base being able to pass between one and the other of the latched closure and intermediate engagement positions, by rotation of the lid with respect to the base about the principal axis of the case using the members for mutual guidance in rotation.

In one embodiment, the pivoting stud is situated on the hinge part associated with the base and the recess is situated on the hinge part associated with the lid.

In another embodiment, the pivoting stud is situated on the hinge part associated with the lid, and the recess is situated on the hinge part associated with the base.

The said one of the hinge parts has two pivoting studs, separated from each other and coaxial, directed along the second axis and in the first direction of rotation with respect to the principal axis of the case and the other hinge part has two recesses, separated from each other, turned respectively towards the pivoting studs and able to receive them.

The members for mutual guidance in rotation comprise raised parts.

The members for mutual guidance in translation comprise raised parts.

The complementary latching members are situated on the faces, turned towards each other, of the first cylindrical walls of the base and of the lid.

The complementary latching members comprise raised parts.

The raised parts are projections.

The cylindrical wall of the lid surrounds that of the base, and the raised parts, such as projections, are directed towards the outside for the base and towards the inside for the lid.

The raised parts, such as projections, are situated at or in the vicinity of the free edges of the first cylindrical walls of the base and lid respectively.

The raised parts, such as projections, are located at several positions around the principal axis of the case, separated by spaces with no raised parts.

The raised parts, such as projections, extend over an arc with a length of the same order of magnitude or a fraction of that of the spaces with no raised parts.

The raised parts, such as projections, are regularly disposed around the principal axis of the case.

The members for mutual guidance in rotation and/or in translation comprise, as raised parts such as projections, on the one hand a first projection on the first cylindrical wall of the lid or base, which has a certain thickness along the principal axis and which extends over an angular sector thereof, centred on this axis, and, on the other hand, second and third projections on the first cylindrical wall of the base or lid, which are spaced apart from each other by an angle less than or equal to the said angular sector and which are spaced apart in height, along the principal axis of the case, by a distance greater than or equal to the said thickness, the second projection being further away from the transverse wall of the base or closer to the transverse wall of the lid than the third.

The second and third projections have parts which are facing each other along the principal axis of the case.

The first, second and third projections comprise complementary threaded parts.

The threaded parts are inclined with respect to a plane transverse to the principal axis of the case, so as to cause, by rotation of the lid with respect to the base in the second direction of rotation from the engagement position, a moving away of the lid with respect to the base.

The complementary latching members comprise, as raised parts such as projections, a first stop on the cylindrical wall of the lid or base and a second stop on the cylindrical wall of the base or lid, the stops being such that, when they are in mutual engagement, they prevent a rotation of the lid with respect to the base in the second direction of rotation with respect to the principal axis of the case and an axial translation of the lid moving it away from the base.

The first stop extends, in the reverse direction to the second direction of rotation, the end, upstream in the second direction of rotation, of the first projection, and the second stop extends, in the reverse direction to the second direction of rotation, the end, upstream in the second direction of rotation, of the second projection.

The stop comprises a section situated substantially in a transverse plane with respect to the principal axis of the case and, upstream of this section in the second direction of rotation, a snub turned towards to the transverse wall of the lid.

The second stop comprises a wedge opposite to the second direction of rotation and turned towards the base.

The second projection is extended, in the second direction of rotation, at its downstream end, by a ramp guiding the snub in the reverse direction to the second direction of rotation.

The third projection is extended, in the reverse direction to the second direction of rotation, by a section situated substantially in a transverse plane with respect to the principal axis of the case.

In one embodiment, the first projection and the first stop are situated on the first cylindrical wall of the lid, and the second and third projections and the second stop are situated on the first cylindrical wall of the base.

In another embodiment, the first projection and the first stop are situated on the first cylindrical wall of the base, and the second and third projections and the second stop are situated on the first cylindrical wall of the lid.

The complementary sealing members issue from the respective walls of the lid and base, are directed along the principal axis of the case, and are situated outside the compartment.

The complementary sealing member for the automatically mating lip has an edge projecting towards the latter, along the principal axis of the case.

In one embodiment, the automatically mating lip and the edge are such that the lip is applied to the internal side of the edge, when the lid is in the latched closure position.

In another embodiment, the automatically mating lip and the edge are such that the lip is applied to the external side of the edge, when the lid is in the latched closure position.

In another embodiment, the automatically mating lip and the edge are such that the lip is applied to the extreme side of the edge, when the lid is in the latched closure position.

The side of the projecting edge to which the automatically mating lip is applied is bevelled in the direction of the latter.

The projecting edge comprises the edge of the cylindrical wall of the base turned towards the lid and the lip issues from a shoulder on the lid, which is situated inside the compartment delimited by the transverse wall of the lid and its cylindrical wall and which is such that it is applied to the internal side of the projecting edge, when the lid is in the latched closure position, the first cylindrical wall of the lid surrounding that of the base.

The automatically mating lip is a moulded-on joint.

The automatically mating lip is made from an elastic material.

The complementary sealing members are formed by revolution with respect to the principal axis of the case.

The lid has an opening passing through its transverse wall and a window made from a translucent material, which is immobilised in the opening.

The window is made from a transparent material.

The opening passing through the transverse wall delimits a disc formed by revolution about the principal axis of the case and the window has the shape of this disc.

The through opening extends substantially as far as the first cylindrical wall of the lid and the window is contiguous with an annular shoulder extending over the circumference of the face of its disc, turned towards the base, the shoulder being designed to receive the sealing member for the lid, able to be compressed by the first cylindrical wall of the base, the case being substantially sealed, with regard to the compartment in the base, in the latched closure position.

The automatically mating lip issues from the shoulder of the window.

The base has, on the side of its transverse wall remote from its first cylindrical wall, walls delimiting a compartment intended to receive a make-up implement, notably a powder puff.

The members for guiding in translation along the principal axis of the case and the members for guiding in rotation about this axis are merged.

The guidance members comprise the complementary threaded parts.

The lid has, issuing from the side of its transverse wall remote from its first cylindrical wall, a second cylindrical wall, delimiting, with the transverse wall, a second compartment, notably for a cosmetic, and the case has a second lid hinged on the base and being able to be situated, when the first lid is in the latched closure position, between two extreme positions,

- a second latched closure position, in which the base and the second lid are associated rigidly with each other opposite each other, the second lid surrounding the second compartment,
- a second position of complete opening, in which the second lid allows access to the second compartment.

Another object of the invention is a powder compact comprising a case as described above and a cosmetic such as make-up with a solid or viscous consistency placed in the first and/or second compartment, directly or by virtue of a refill container.

The invention also provides a method for the complete opening of a case, from the latched closure position, comprising the following successive phases:

- a first phase at least of rotation of the lid with respect to the base about the principal axis of the case, as far as the intermediate engagement position,
- a second phase of pivoting of the lid with respect to the base about the second axis from the engagement position to the intermediate position of complete opening.

The invention also provides a method of closing a case, from the complete opening position, comprising the following successive steps:

- a first step of pivoting the lid with respect to the base about the second axis, as far as the intermediate engagement position,
- a second step of rotation of the lid with respect to the base about the principal axis of the case, from the intermediate engagement position to the latched closure position.

The invention will be clearly understood in the light of the detailed description which follows, with reference to the accompanying drawings, given by way of non-limitative example.

DETAILED DESCRIPTION OF THE PREFERRED EMBODIMENTS

Figure 1:
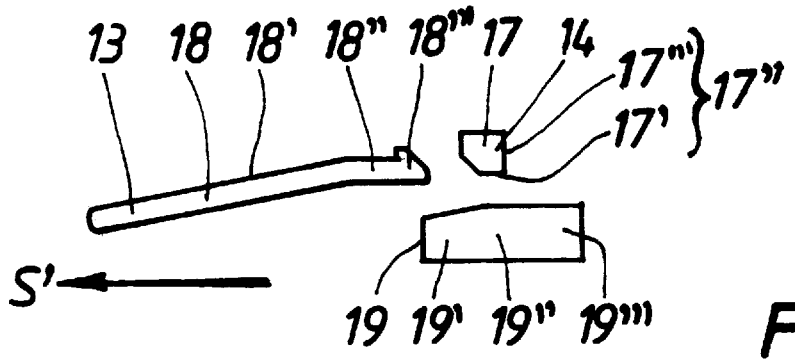
FIG. 1 is a schematic representation, developed on a plane, of the first, second and third projections on the first cylindrical walls of a case according to the invention in the fitting position.

A case 1 according to the invention, produced from plastic material, is particularly intended to receive a cosmetic such as a make-up with a solid or viscous consistency.

The make-up in question may require to be protected against moisture or ambient air.

To this end, the case 1 is arranged so as to be able to be made substantially airtight when this proves necessary.

In the embodiment depicted, the case 1 has a hollow base 2, provided with:

- a transverse wall 3, and
- a first wall 4 with a roughly cylindrical shape with respect to a principal axis 5 of the case, defining, with the transverse wall 3, a compartment 6, notably for make-up.

The case 1 also has a hollow lid 7, provided with:

a transverse wall 8, and a first wall 9 of roughly cylindrical shape with respect to the principal axis 5 of the case.

The cylindrical walls 4, 9 are perpendicular respectively to the transverse walls 3, 8 of the base 2 and of the lid 7.

The make-up can fill the compartment 6 until it is flush with the free edge 4*a* of the cylindrical wall of the base.

The base 2 has a second toric wall 4' connected to the outside of its transverse wall 3 and of its first cylindrical wall 4, and delimiting, with the first cylindrical wall 4, a first external space open on the same side as the compartment 6.

The toric surface 4' is formed by revolution about an axis 5' parallel to the axis 5, and situated at a given distance therefrom.

The lid 7 has, in the same way, an external toric wall 9' connected to its transverse wall 8 and to its first cylindrical wall 9, and formed by revolution about the axis 5'.

The toric wall 9' delimits, with the first cylindrical wall 9, a second external space open towards the same side as the space delimited by the first cylindrical wall 9 and the transverse wall 8.

In a particular embodiment, not shown, the first cylindrical wall 4 and the external toric wall 4' of the base 2 are formed by revolution about the same axis 5, and the first cylindrical wall 9 of the lid and its toric external wall 9' are formed by revolution about this same axis 5.

In the embodiment depicted, where the two parallel axes 5, 5' are spaced apart by a given distance in a direction (δ) transverse to the base and to the lid, the first cylindrical wall 4 and the external toric wall 4' of the base 2 are connected, on a given angular sector, symmetrical with respect to the transverse direction (δ) in a transverse plane of the base 2, in a step 4" turned towards the outside.

This step 4" and the part of the first cylindrical wall 4 of the base 2 and of its external toric wall 4', which are situated outside the angular sector over which it extends, delimit the first external space 4'", which is in the shape of a crescent moon, in a transverse plane, symmetrical with respect to the direction (δ).

Likewise, in the embodiment depicted, the external toric wall 9' of the lid 7 and its first cylindrical wall 9 are connected on the given angular sector over which the step of the base 2 extends, in a transverse plane of the lid, in a common projecting edge 9", complementary to the step 4".

This common projecting edge 9" delimits, with the part of the external toric wall 9' of the lid and the part of the first cylindrical wall 9 of the lid, which are situated outside the given angular sector in a transverse plane of the lid, a second external space 9'" in the shape of a crescent moon, symmetrical with respect to the direction (δ).

In the embodiment, not shown, where the axes 5 and 5' are merged, the external spaces included between the first walls 4, 9 and the external toric walls 4', 9' respectively of the base 2 and of the lid 7 are annular and run around their first walls, the step and its complementary part on the lid not being present.

In the embodiment depicted, the transverse wall 3 of the base is flat.

However, in another embodiment, it could be curved, for example, with a concavity turned towards the inside of the case.

In the embodiment depicted, the transverse wall 8 of the lid 7 is curved, having a concavity turned towards the inside of the case 1.

However, in another embodiment, the said wall could be flat.

The lid 7 has, issuing from the inside of its external toric wall 9' and/or from the outside of its first cylindrical wall 9, a male hinge part 11, having a pivoting stud 15 directed along a pivot axis 12 perpendicular to the principal axis 5 of the case and directed in a first direction of rotation S with respect to this axis.

In the embodiment depicted, the lid 7 has two male hinge parts 11, situated at a given distance from each other on each side of the axis (δ) of the lid, the pivoting studs 15 being coaxial, and directed in the first direction S of rotation.

The base 2 has, issuing from the inside of its external toric wall 4' and/or from the outside of its first cylindrical wall 4, a female hinge part 10, having a recess 16 able to receive a pivoting stud 15 and directed along the pivot axis 12 in a second direction S' of rotation, opposite to the first direction S of rotation with respect to the principal axis 5 of the case.

In the embodiment depicted, the recess passes right through, along the pivot axis 12.

In another embodiment, the recess 16 can be a blind hole turned in the second direction S' of rotation.

In the embodiment depicted, the base 2 has two female hinge parts 10, spaced apart from each other by the same distance as that by which the male hinge parts of the lid are spaced, and having coaxial recesses.

The pivoting studs 15 are able to engage in the recesses 16, enabling the lid to rotate with respect to the base about the pivot axis 12.

The pivot axis 12 is perpendicular to the principal axis 5 of the case.

In the embodiment depicted, the pivot axis 12 is perpendicular to the axis δ.

In another embodiment, the male hinge parts are situated on the base and the female hinge parts are situated on the lid.

When the male hinge parts are engaged in the female hinge parts, the lid 7 can tilt with respect to the base 2 in an extreme position of complete opening, in which the lid 6 allows free access to the compartment 6 in the base 2, and therefore to the make-up.

The lid 7 has, in the space delimited by its transverse wall 8 and by its first cylindrical wall 9, a mirror, which can then be used.

In this position, the transverse planes of the lid 7 and of the base 2 are inclined with respect to each other by an angle of more than 90°, for example 110°.

Figure 7:
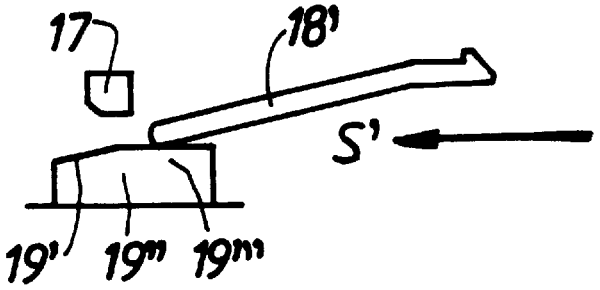
FIG. 7 is a schematic view, developed on a plane, of the first, second and third projections on the first cylindrical walls, in the non-latched closure position.
Figure 8:
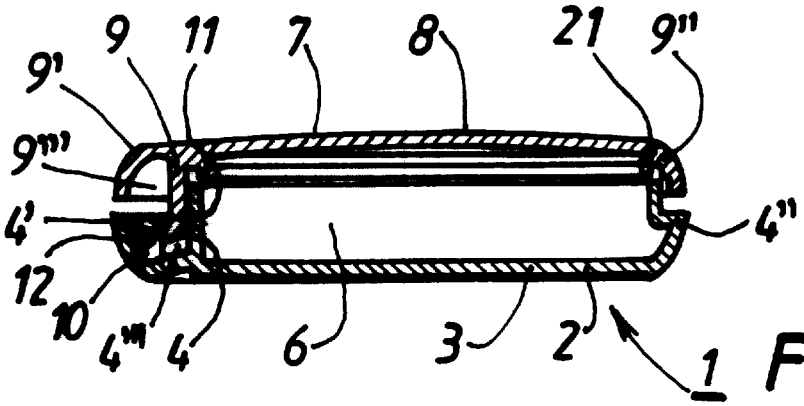
FIG. 8 is a schematic view in section, through an axial plane of the case according to the invention, in the non-latched closure position.
Figure 9:
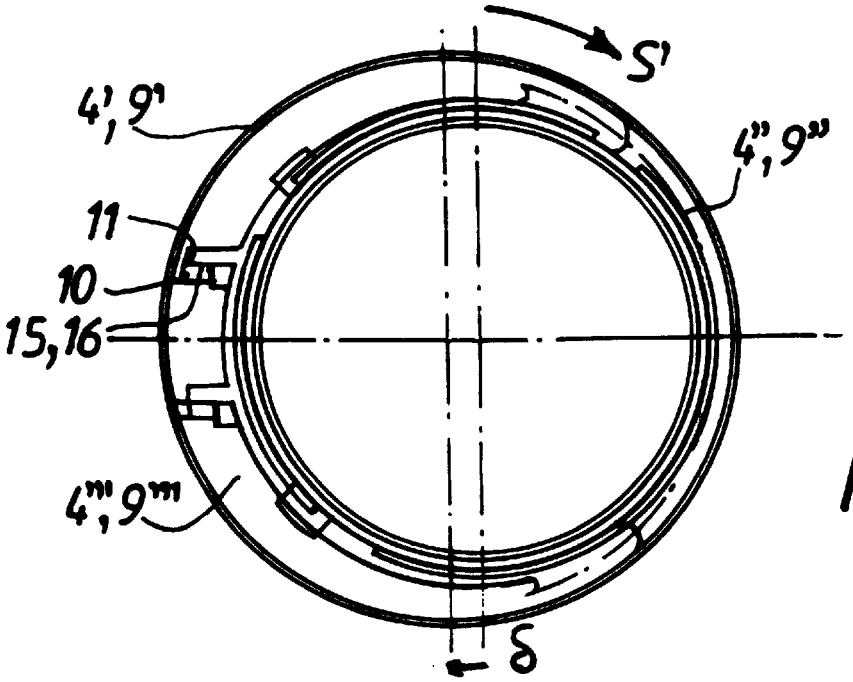
FIG. 9 is a schematic top view of the case according to the invention, in the non-latched closure position.
Figure 10:
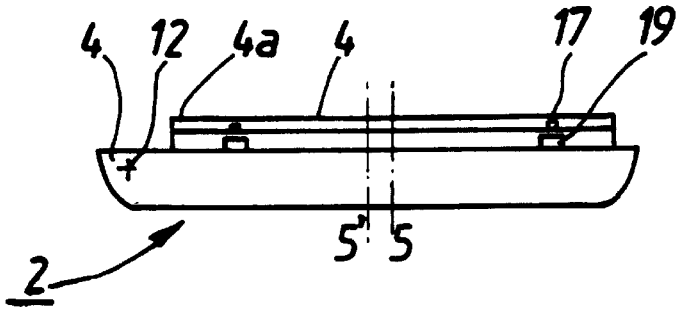
FIG. 10 is a schematic side view of the base of the case.
Figure 11:
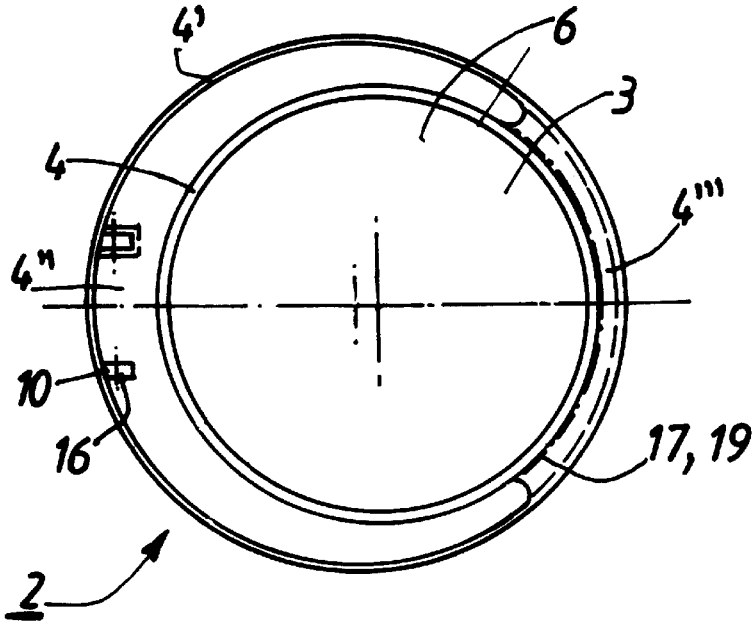
FIG. 11 is a schematic top view of the base of the case.

The lid 7 can be situated, with respect to the base 2, in a non-latched closure position, or engagement position (FIGS. 7, 8, 9), into which it can pass, from the complete opening position, by folding down the lid 2 onto the base 2 about the pivot axis 12.

When there is tilting between one and the other of the complete opening and non-latched closure positions, the male hinge parts are engaged in the female hinge parts and the pivoting studs 15 turn, on the pivot axis 12, in their associated recesses 16.

The first cylindrical walls 4, 9 of the base 2 and case 7 are such that, in the non-latched closure position, one of the first walls of the lid or of the base surrounds the other first cylindrical wall of the lid or base.

In the embodiment depicted, the first cylindrical wall 9 of the lid 7 surrounds that 4 of the base 2.

In another embodiment, the first cylindrical wall 4 of the base surrounds that 9 of the lid 7.

In this position, the transverse walls 3, 8 of the base 2 and of the lid 7 are facing and the external toric walls 4', 9' are opposite each other, defining a transverse joining plane at their free edges.

The step 4" on the base is facing its complementary part 9".

Figure 4:
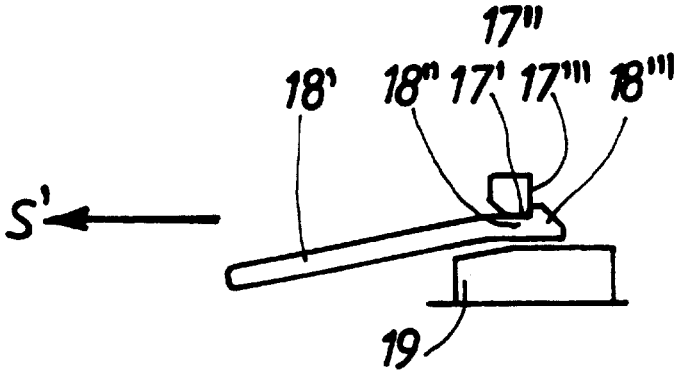
FIG. 4 is a schematic view, developed on a plane, of the first, second and third projections on the first cylindrical walls, in the latched closure position.
Figure 5:
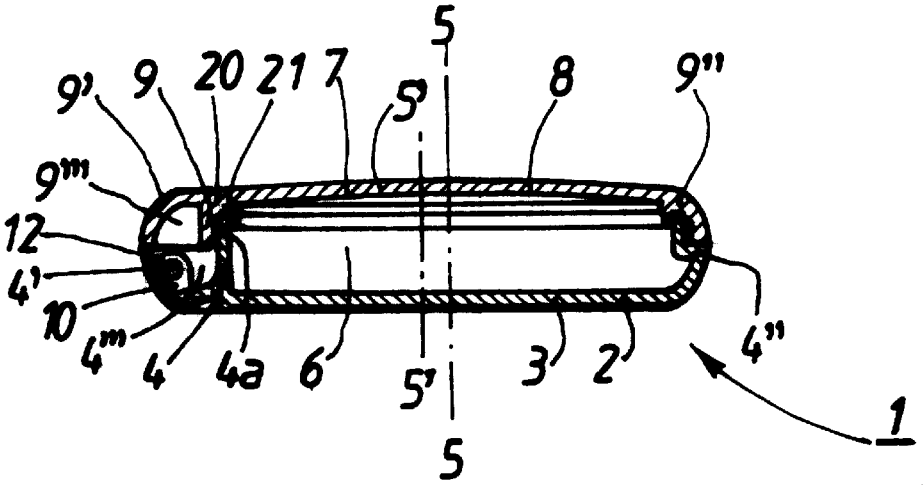
FIG. 5 is a schematic view in section, through an axial plane of the case according to the invention, in the latched closure position.
Figure 6:
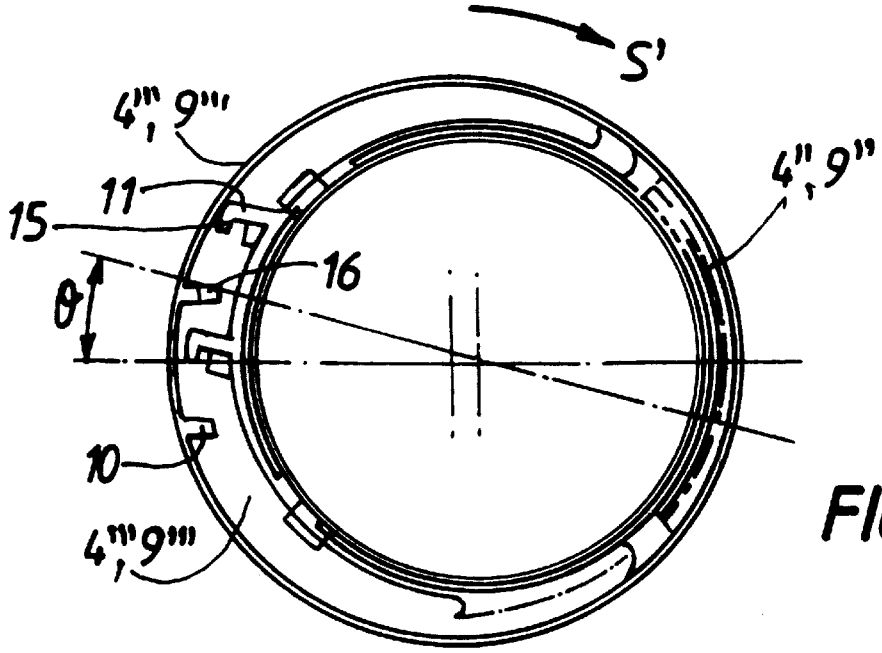
FIG. 6 is a schematic top view of the case according to the invention, in the latched closure position.

The lid 7 can be situated in a latched closure position (FIGS. 4, 5, 6), in which the base 2 and lid 9 are associated rigidly with each other opposite each other.

This position is reached, from the non-latched closure position, by rotating the lid 7 with respect to the base, with respect to the principal axis 5 of the case in the second direction S' of rotation, through a given angle θ.

In the latched closure position, the male hinge parts are disengaged from the female hinge parts and the lid 7 is latched on the base 2 by complementary latching members 13, 14, which prevent a movement of the lid 7 with respect to the base 2 on the principal axis 5 of the case, moving the lid away from the base and preventing rotation beyond the angle θ in the second direction S' of rotation about the principal axis 5 of the case.

The angle θ is between 10° and 30° and is for example 16°.

In addition, the base 2 and lid 7 have members 17, 18, 19 for mutual guidance in rotation with respect to the principal axis 5 of the case.

The members 17, 18, 19 for mutual guidance in rotation are situated on the internal face of the first cylindrical wall 9 of the lid 7 and on the external face of the first cylindrical wall 4 of the base 2.

In the embodiment depicted, the complementary latching members 13, 14 are also situated respectively on the internal face of the first cylindrical wall 9 of the lid 7 and on the external face of the first cylindrical wall 4 of the base 2.

In another embodiment, not shown, the complementary latching members 13, 14 respectively on the lid and on the base issue from their respective external toric walls 9', 4' and/or from their respective first cylindrical walls 9, 4 in the space 9''', 4''' delimited by them.

The mutual guidance members 17, 18, 19 and the mutual latching members 13, 14 are situated, in the embodiment depicted, in the vicinity of the free edges 4*a*, 9*a* of the first cylindrical walls 4, 9 and on the parts of their faces which are opposite in the latched closure position.

When the mutual latching members 13, 14 are in mutual engagement, the lid 7 is in the latched closure position.

In the embodiment under consideration, the complementary latching members 13, 14 and the guidance members are respectively in the form of raised parts such as projections.

The members for mutual guidance in rotation comprise, on the cylindrical wall 9 of the lid 7, a first projection 18, extending over an angular sector thereof.

They also comprise, on the cylindrical wall 4 of the base 2, a second projection 17 and a third projection 19, spaced apart from each other along a generator of the cylindrical wall, by a distance greater than or equal to the thickness of the first projection 18 and opposite each other along the said generator, the second projection 17 being closer to the transverse wall 8 of the lid 7 or further away from the transverse wall 3 of the base 2 than the third projection 19.

The first and second projections 18, 17 are such that, in the non-latched closure position, they are not opposite, on the principal axis 5 of the case.

In another embodiment, the second projection 17 is spaced apart from the third projection 19, angularly, by an angle less than or equal to the angular sector over which the first projection 18 extends.

The first projection 18 has a threaded part 18' and the second and third projections 17, 19 have complementary threaded parts 17', 19' able to cooperate by rotation and translation, composed along the principal axis 5 with the threaded part 18' of the first projection 18.

In another embodiment, not shown, the first projection 18 extends in a transverse plane of the lid and the second and third projections 17, 19 extend in a transverse plane of the base, providing the mutual guidance in rotation of the lid 7 with respect to the base 2.

The third projection 19 has, upstream of its threaded part 19' in the second direction S' of rotation, an extension 19" situated substantially in a transverse plane of the base and having an extreme part 19''', situated facing a space with no raised parts on its wall, along the axis 5 and towards the lid 7.

The part of the threads 18' on the first projection 18 is extended, in the reverse direction to the second direction S' of rotation, in a section 18" situated substantially in a transverse plane, itself extended by a snub 18''' having a front part turned in the second direction S' of rotation and a rear wall turned counter to the second direction S' of rotation and rising up towards the transverse part 8 of the lid 7.

The second projection 17 has, upstream of its threaded part 17' in the second direction S' of rotation, a stop 17" having a wall 17''' complementary to the front part of the snub and turned counter to the second direction S' of rotation.

In the latched closure position, the front part of the snub 18''' abuts against the wall 17''' of the stop 17", preventing rotation of the lid 7 with respect to the base 2 in the second direction S' of rotation.

In this position, the section 18" of the first projection comes into engagement with the threaded part 17' of the second projection 17 and is situated between the second projection 17 and third projection 19, along a generator of the cylindrical wall, preventing movement of the lid 7 with respect to the base 2, along the principal axis 5 of the case, moving it away therefrom.

The section 18" and the snub 18''' serve as a latching member 13 on the first cylindrical wall 9 of the lid, and the stop 17" and the threaded part 17' of the second projection 17 serve as a complementary latching member 14 on the first cylindrical wall 4 of the base.

In another embodiment, not shown, the section 18" and the snub 18''' are spaced apart from the threaded part 18' of the first projection 18 on the first cylindrical wall of the lid and form its latching member 13, and the complementary latching member 14 on the first cylindrical wall of the base is formed by a stop 17" on this wall of complementary shape to the part of the section 18", which is turned towards the lid, and to the part of the snub 18''' turned in the second direction S' of rotation, and which is spaced apart from the threaded part 17'.

In another embodiment, not shown, the section 18" and the snub 18''' project from the internal face of the first cylindrical wall 9 of the lid 7 and the complementary stop 17" is a projection on the external face of the first cylindrical wall 4 of the base.

In another embodiment, not shown, the first projection 18 is situated on the cylindrical wall 4 of the base and the second and third projections 17, 19 are situated on the cylindrical wall 9 of the lid.

In the embodiment depicted, the passage between one and the other of the non-latched closure and latched closure positions is effected by guiding the first projection 18 between the second and third projections 17, 19.

The threaded part 18' of the first projection 18 and the second and third projections 17, 19 are disposed so that, in the non-latched closure position, the extreme part, downstream in the second direction S' of rotation, of the first threaded part 18' rests on the part 19''' of the extension 19" of the third project-on 19, on the principal axis of the case, and so that, in the latched closure position, the front part of the snub 18"', oriented in the second direction S' of rotation, is applied against the complementary part 17"' of the stop 17".

The threaded parts 17', 18', 19' of the first, second and third projections 17, 18, 19 are inclined with respect to a transverse plane, so as to cause a translational movement of the lid 7 with respect to the base 2 along the principal axis 5 of the case, moving it away therefrom, when passing from the latched closure position to the non-latched closure position.

The second projection 17 has, in line with its threaded part 17' in the second direction S' of rotation, a ramp 17"", substantially with a shape complementary to that of the rear part of the snub 18"' and able to guide it in the reverse direction to the second direction S' of rotation.

The case can be assembled using a base 2 and a separate lid 7.

Figure 2:
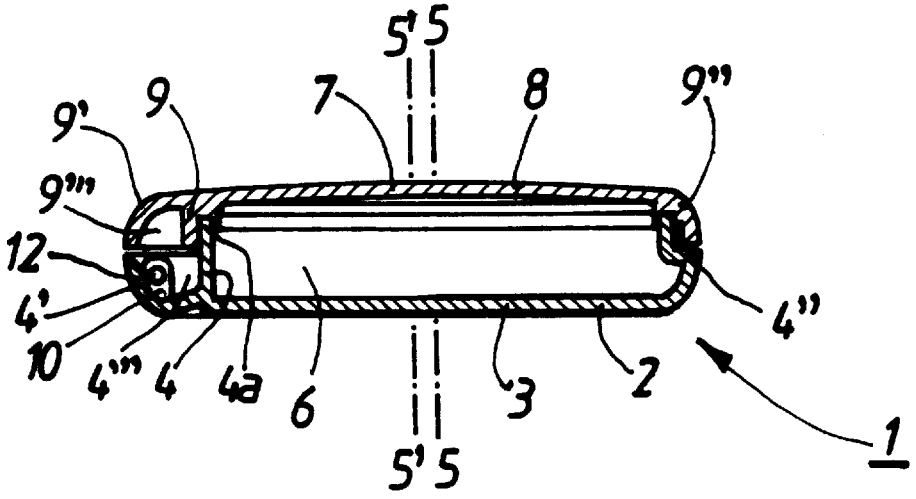
FIG. 2 is a schematic view in section, through an axial plane of the case according to the invention, in a fitting position.
Figure 3:
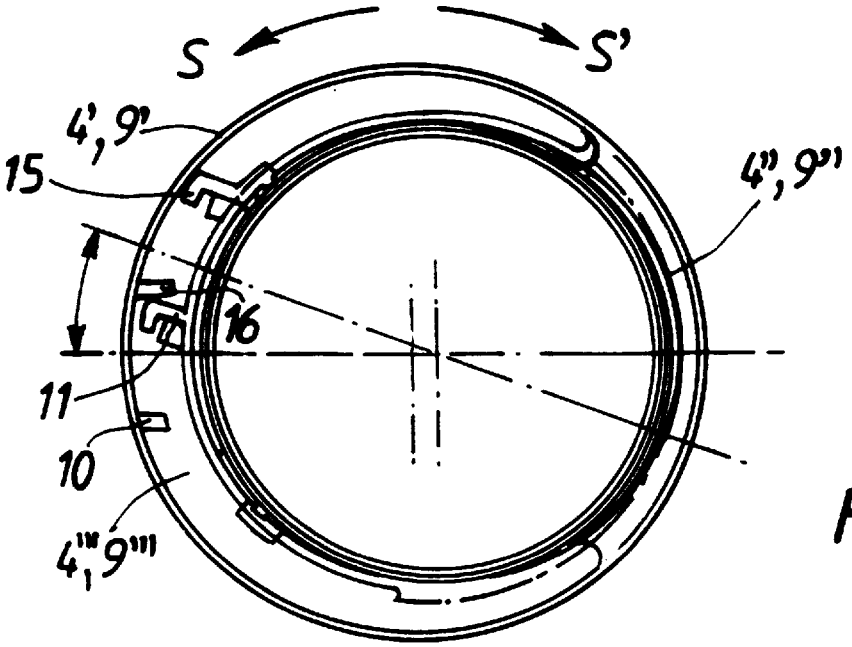
FIG. 3 is a schematic top view of the case according to the invention in the fitting position.

To this end, the lid 7 is applied to the base 2 in a fitting position (FIGS. 1, 2, 3), in which the cylindrical wall of the lid surrounds that of the base and in which the external toric walls 9', 4' of the lid and of the base are opposite, in which the lid is in an angular position about the principal axis 5 of the case, with respect to the base, where the rear part of the snub 18" is downstream, in the second direction S' of rotation of the guide ramp 17"".

Assembly is effected by rotating the lid with respect to the base, from this fitting position, in the reverse direction to the second direction S' of rotation, until the latching members 13, 14 come into engagement.

The case is then in the latched closure position.

The position of fitting of the lid on the base corresponds to an angle, in a transverse plane, with respect to the non-latched closure position, greater than the angle θ, and for example 21°.

The lid 7 has, issuing from the internal face of its first cylindrical wall 9 and from its transverse wall 8, an annular shoulder 20.

In the non-latched closure position, the shoulder 20 is such that it is facing, on the principal axis 5 of the case, the free edge 4*a* of the first cylindrical wall 4 of the base 2.

This shoulder 20 is extended along the principal axis 5 of the case towards the transverse wall 3 of the base in the non-latched closure position of the lid on the base, in an automatically mating lip 21.

The lip 21 is such that it is applied sealingly to the free edge 4*a* of the first cylindrical wall 4 of the base 2 in the latched closure position.

In the embodiment depicted, the lip 21 is applied by its external part to the internal side of the free edge 4*a* of the cylindrical wall 4 of the base 2.

The lip 21 delimits, with the shoulder 20 and the internal face of the first cylindrical wall 9, an annular space with a U-shaped transverse section, open towards the base 2.

In the latched closure position, the free edge 4*a* of the first cylindrical wall of the base 2 is situated in this U-shaped annular space.

The free edge 4*a* is bevelled annularly, on its internal side, towards the lip 21.

The lip 21 is applied sealingly to this bevel in the latched closure position.

In the embodiment where the first cylindrical wall 4 of the base surrounds that 9 of the lid 7, the lip can be provided outside the first cylindrical wall 9 of the lid 7, issuing from a shoulder on the outside of this wall and of the external toric wall 9' , the lip being applied, in the latched closure position, by its internal part, to the external side of the free edge of the first cylindrical wall 4 of the base 2.

In the non-latched closure position, the lip 21' is disengaged from the free edge of the cylindrical wall of the base 2, enabling the lid 7 to tilt with respect to the base 2 about the pivot axis 12.

This disengagement is effected by translational movement of the lid 7 with respect to the base 2 on the principal axis 5 of the case in the direction moving it away from the base 2. The application of the automatically mating lip 21' to the free edge 4*a* of the first cylindrical wall 4 of the base 2 is effected by translational movement of the lid 7, on the principal axis 5 of the case, towards the base 2.

This axial translational movement is made possible by the guidance of members for mutual translational guidance of the lid and base on the principal axis 5 of the case.

In the embodiment depicted, the threaded parts 17', 18', 19' of the first, second and third projections 17, 18, 19, on the first cylindrical walls 4, 9 of the base and lid, serve as members for mutual guidance in translation on the principal axis 5 of the case.

In another embodiment, the members for guidance in translation on the principal axis 5 of the case are distinct from the threaded parts 17', 18', 19' of the first, second and third projections 17, 18, 19.

The first, second and third projections 17, 18, 19 are disposed regularly on their respective walls around the principal axis 5 of the case.

In the embodiment depicted, the case has four first, second and third projections 17, 18, 19.

In other embodiments, the case 1 has three first, second and third projections or five first, second and third projections 17, 18, 19.

The automatically mating lip 21 is a joint moulded onto the shoulder 20 and is made from an elastic material. It is formed by revolution about the principal axis 5 of the case.

In another embodiment, not shown, where the lid 7 does not have an interior mirror, the transverse wall 8 of the lid 7 has a window made from a translucent or transparent material.

In one embodiment, not shown, the base 2 has, on the face of its transverse wall 3, at a distance from its first cylindrical wall 4, walls delimiting a compartment intended to receive a make-up implement, notably a powder puff.

In another embodiment of the case, the lid 7 has, issuing from the side of its transverse wall 8 remote from its first cylindrical wall 9, a second cylindrical wall 22, delimiting, with the transverse wall 8, a second compartment 23, notably for a cosmetic.

Figure 15:
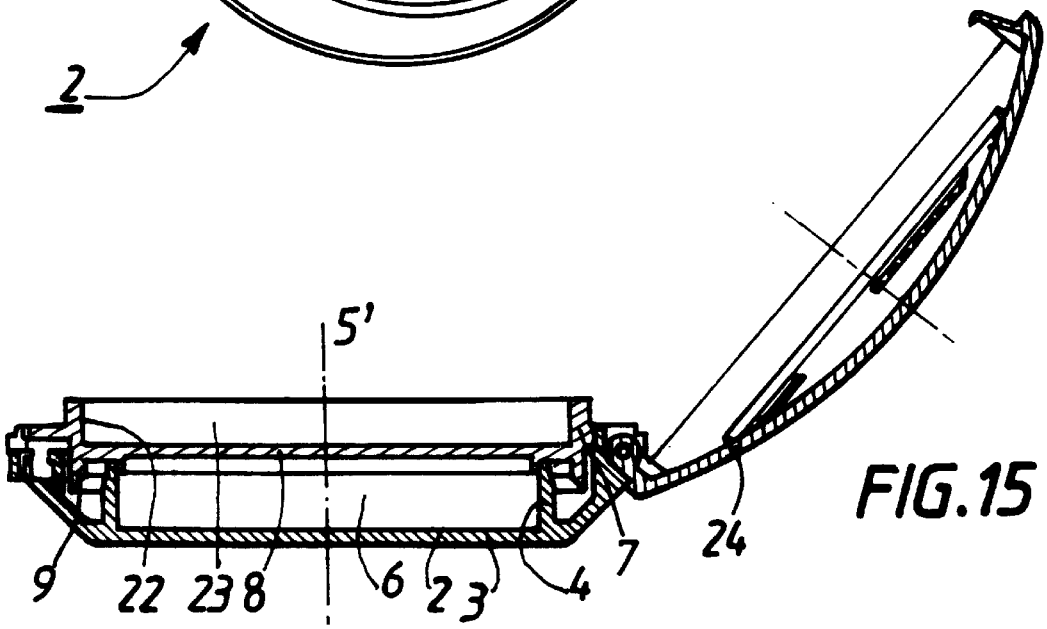
FIG. 15 is a schematic view, in section along an axial plane, of an improvement to the case according to the invention.
Figure 13:
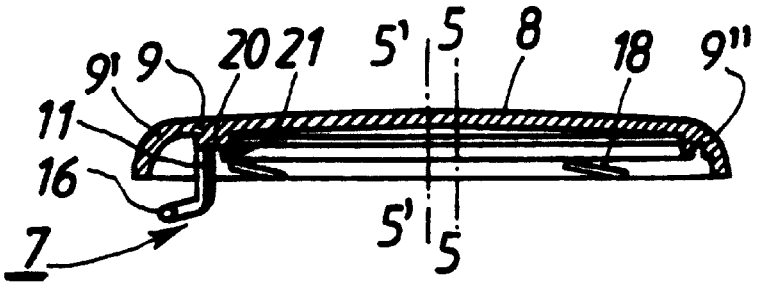
FIG. 13 is a schematic view in section, along an axial plane, of the lid of the case.
Figure 14:
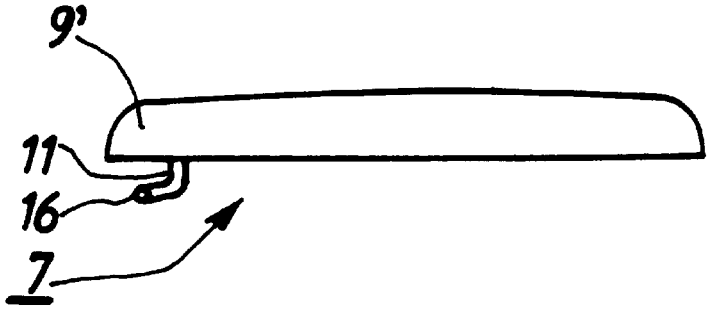
FIG. 14 is a schematic side view of the lid of the case.
Figure 12:
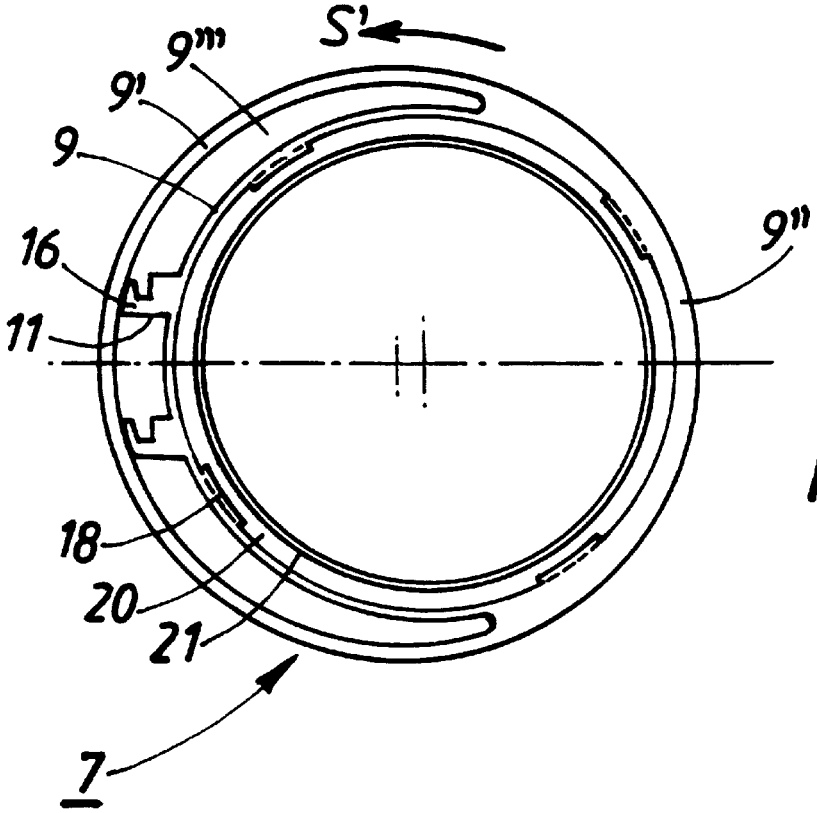
FIG. 12 is a schematic view from below of the lid of the case.

The case has a second lid 24 hinged on the base 2 and able to be situated, when the first lid is in the latched closure position, between two extreme positions:

- a second latched closure position, in which the base 2 and the second lid 24 are rigidly associated with each other, opposite one another, the second lid 24 surrounding the second compartment,
- a second complete opening position (FIG. 15) in which the second lid 24 allows access to the second compartment 23.

What is claimed is:

1. A case for cosmetics, comprising:

a base (2) provided with a transverse wall (3) and a first wall (4) of roughly cylindrical shape with respect to a principal axis (5) defining, with the wall (3), a compartment (6) for make-up, a lid (7) provided with a transverse wall (8) and a first wall (9) of roughly cylindrical shape with respect to the axis (5);

means forming a hinge (10, 11) around a second axis (12) orthogonal to the axis (5) at the periphery of the walls (4, 9), and comprising a first part (10), associated with the base (2), and a second part (11), associated with the lid (7);

the lid (7) and base (2) being able to be situated, with respect to each other, in two extreme positions: a latched closure position, and a complete opening position;

the lid (7) and base (2) being able to pass from one to another of these positions, and this passage entailing at least a tilting of the lid (7) with respect to the base (2) about the second axis (12);

complementary latching members (13, 14), respectively for the base (2) and for the lid (7), which, when said latching members (13, 14) are in mutual engagement, enable the lid (7), to be in the latched closure position and which, when said latching members (13, 14) are mutually disengaged, enable the lid to be brought to and be situated in the complete opening position;

one (9) of the first walls (4, 9) of the base and of the lid surrounding the other first cylindrical wall (4), in the latched closure position, characterized in that one (11) of the hinge parts comprises at least one pivoting stud (15), directed along the second axis (12), and in a first direction (S) of rotation with respect to the axis (5), and the other hinge part (10) has at least one recess (16), turned towards the stud (15) and able to receive said stud (15);

the base (2) and lid (7) have members (17, 18, 19) for mutual guidance in rotation about the axis (5) on the faces of their first walls (4, 9) turned towards each other;

the lid (7) and base (2) can be situated, with respect to each other, in an intermediate engagement position, in which the complementary latching members (13, 14) are mutually disengaged, and the pivoting stud (15) is engaged in the recess (16), allowing pivoting about the axis (12);

the stud (15) being:

in the complete opening position, engaged in the recess (16), allowing pivoting about the axis (12), in the latched closure position, disengaged from the recess (16), the lid (7) and base (2) being able to pass from one to the other of the complete opening and intermediate engagement positions, by pivoting of the stud (15) in the recess (16) about the axis (12);

the lid (7) and base (2) being able to pass from one to the other of the latched closure and intermediate engagement positions, by rotation of the lid (7) with respect to the base (2) about the axis (5) of the case using the members (17, 18, 19) for mutual guidance in rotation.

2. A case, for cosmetics, comprising:

a base (2), provided with a transverse wall (3) and a first wall (4) of roughly cylindrical shape with respect to a principal axis (5), defining, with the wall (3), a compartment (6), notably for make-up;

a lid (7) provided with a transverse wall (8) and a first wall (9) of roughly cylindrical shape with respect to the axis (5);

means forming a hinge (10, 11) around a second axis (12), orthogonal to the axis (5) at the periphery of the first walls (4, 9), and comprising a first part (10), associated with the base (2), a second part (11), associated with the lid (7), the lid (7) and base (2), being able to be situated, with respect to each other, between two extreme positions: a latched closure position and a complete opening position;

the lid (7) and base (2) being able to pass from one to another of these positions, this passage entailing at least a tilting of the lid (7) with respect to the base (2) about the axis (12);

complementary latching members (13, 14), respectively for the base (2) and for the lid (7), which, when said latching members (13, 14) are in mutual engagement, enable the lid (7) to be in the latched closure position and which, when said latching members (13, 14) are mutually disengaged, enable the lid to be brought to and be situated in the complete opening position, one (9) of the first walls (4, 9) of the base and of the lid surrounding the other first wall (9, 4) in the latched closure position;

the base (2) and lid (7) having complementary sealing members, able, when the lid (7) is in the latched closure position, to be applied against each other in order to seal the compartment (6);

characterized in that the lid (7) and base (2) can be situated with respect to each other in an intermediate engagement position in which the complementary latching members (13, 14) are mutually disengaged and the first part of the hinge (10) cooperates with the second part (11) of the hinge, allowing pivoting about the axis (12);

the base (2) and lid (7) have members (17, 18, 19) for mutual guidance in translation along the principal axis (5) of the case and members (17, 18, 19) for mutual guidance in rotation on this axis, on the faces of their first walls (4, 9) turned towards each other;

the sealing members comprising at least one automatically mating lip (21), on the lid (7), able to be applied sealing to a part of the base (2), forming a complementary sealing member;

the automatically mating lip (21) being:

in the latched closure position, applied sealingly to the said part of the base (2), disengaged from this part, in the position of engagement and complete opening of the lid (7) and base (2), the first and second hinge parts (10, 11) are such that, essentially by rotation from the engagement position on the axis (5) by the means (17, 18, 19) of mutual guidance in rotation, the first part (10) is disengaged from the second part (11): the first and second hinge parts (10, 11):

being disengaged from each other in the latched closure position, cooperating in the complete opening position, the lid (7) and base (2) being able to pass between one and the other of the complete opening and intermediate engagement positions, by pivoting of the second part (11) with respect to the first part (10) about the axis (12);

the lid (7) and base (2) being able to pass from one to the other of the latched closure and intermediate engagement positions, by rotating the lid (7) with respect to the base (2) about the axis (7) using the members (17, 18, 19) for mutual guidance in rotation, and by moving the lid (7) in translation with respect to the base (2) on the axis (5) using the members (17, 18, 19) for mutual guidance in translation.

3. A case, for cosmetics, comprising:

a base (2) provided with a transverse wall (3) and a first wall (4) of roughly cylindrical shape with respect to a principal axis (5), defining, with the wall (3), a compartment (6), notably for make-up;

a lid (7) provided with a transverse wall (8) and a first wall (9) of roughly cylindrical shape with respect to the axis (5);

means forming a hinge (10, 11) around a second axis (12) orthogonal to the axis (5) at the periphery of the first walls (4, 9) and comprising a first part (10), associated with the base (2), a second part (11), associated with the lid (7), the lid (7) and base (2) being able to be situated, with respect to each other, between two extreme positions: a latched closure position and a complete opening position;

the lid (7) and base (2) being able to pass from one to another of these positions, this passage entailing at least a tilting of the lid (7) with respect to the base (2) about the axis (12);

complementary latching members (13, 14), respectively for the base (2) and for the lid (7), which, when said latching members (13, 14) are in mutual engagement, enable the lid (7) to be in the latched closure position and which, when said latching members (13, 14) are mutually disengaged, enable the lid to be brought to and be situated in the complete opening position;

one of the first walls (4, 9) of the base surrounding the other first wall (9, 4) in the latched closure position;

the base (2) and lid (7) having complementary sealing members, able, when the lid (7) is in the latched closure position, to be applied against each other in order to seal the compartment (6);

characterized in that one (11) of the hinge parts comprises at least one pivoting stud (15), directed along the second axis (12) and in a first direction (S) of rotation with respect to the axis (5), and the other hinge part (10) has at least one recess (16), turned towards the stud (15) and able to receive said stud (15);

the base (2) and lid (7) have members (17, 18, 19) for mutual guidance in translation on the principal axis (5) of the case and members (17, 18, 19) for mutual guidance in rotation about this axis (5), on the faces of their cylindrical walls (4, 9) turned towards each other;

the lid (7) and base (2) can be situated, with respect to each other, in an intermediate engagement position, in which the complementary latching members (13, 14) are mutually disengaged, and the pivoting stud (15) is engaged in the recess (16), allowing pivoting about the axis (12);

the stud (15) being:

in the complete opening position, engaged in the recess (16), allowing pivoting about the axis (12), in the latched closure position, disengaged from the recess (16), the lid (7) and base (2) being able to pass from one to the other of the complete opening and intermediate engagement positions, by pivoting of the stud (15) in the recess (16) about the second axis (12);

the sealing members comprising at least one automatically mating lip (21), on the lid (7), able to be applied sealingly to a part of the base (2), forming a complementary sealing member;

the automatically mating lip (21) being:

in the latched closure position, applied sealingly to the said part of the base (2), disengaged from this part, in the position of engagement and complete opening of the lid (7) and base (2), the lid (7) and base (2) being able to pass between one and the other of the latched closure and intermediate engagement positions, by rotating the lid (7) with respect to the base (2) about the axis (7) using the members (17, 18, 19) for mutual guidance in rotation, and by moving the lid (7) in translation with respect to the base (2) on the axis (5) using the members (17, 18, 19) for mutual guidance in translation.

4. A case according to claim 1, characterized in that the pivoting stud (15) is situated on the hinge part (10) associated with the base and the recess (16) is situated on the hinge part (11) associated with the lid.

5. A case according to claim 1, characterized in that the pivoting stud (15) is situated on the hinge part (11) associated with the lid, and the recess (16) is situated on the hinge part (10) associated with the base.

6. A case according to claim 1, characterized in that said one (11) of the hinge parts has two pivoting studs (15) separated from each other and coaxial, directed along the second axis (12) and in the first direction (S) of rotation with respect to the principal axis (5) of the case and the other hinge part (10) has two recesses (16), separated from each other, turned respectively towards the pivoting studs (15) and able to receive said studs (15).

7. A case according to claim 1, characterized in that the members (17, 18, 19) for mutual guidance in rotation comprise raised parts.

8. A case according to claim 2, characterized in that the members (17, 18, 19) for mutual guidance in translation comprise raised parts.

9. A case according to claim 1, characterized in that the complementary latching members are situated on the faces, turned towards each other, of the first cylindrical walls (4, 9) of the base and of the lid.

10. A case according to claim 1, characterized in that the complementary latching members (13, 14) comprise raised parts.

11. A case according to claim 7, characterized in that the raised parts are projections.

12. A case according to claim 7, characterized in that the cylindrical wall (9) of the lid (7) surrounds that (4) of the base, and the raised projections (13, 14, 17, 18, 19), are directed towards the outside for the base (2) and towards the inside for the lid (7).

13. A case according to claim 7, characterized in that the raised parts (13, 14, 17, 18, 19) are situated in the vicinity of the free edges of the first cylindrical walls of the base (2) and lid (7) respectively.

14. A case according to claim 7, characterized in that the raised parts, namely projections (13, 14, 17, 18, 19), are located at several positions around the principal axis (5) of the case, separated by spaces with no raised parts.

15. A case according to claim 14, characterized in that the raised parts, namely projections (13, 14, 17, 18, 19), extend over an arc with a length of a fraction of that of the spaces with no raised parts.

16. A case according claim 7, characterized in that the raised parts, namely projections (13, 14, 17, 18, 19), are regularly disposed around the principal axis (5) of the case.

17. A case according to claim 7, characterized in that the members for mutual guidance in rotation (17, 18, 19) and in translation comprise, the raised projections, being on the one hand a first projection (18) on the first cylindrical wall (4, 9) of the lid (7) and on base (2), which have a certain thickness along the principal axis (5) and which extend over an angular sector thereof, centered on this axis (5), and, on the other hand, second and third projections (17, 19) on the first cylindrical wall (9, 4) of the base (2) and lid (7), which are spaced apart from each other by an angle no greater than than said angular sector and which are spaced apart in height, along the principal axis (5) of the case, by a distance no less than said thickness, the second projection (17) being further away from the transverse wall (3) of the base (2) and no closer to the transverse wall (8) of the lid (7) than the third one.

18. A case according to claim 17, characterized in that the second and third projections (17, 19) have parts which are facing each other along the principal axis (5) of the case.

19. A case according to claim 17, characterized in that the first, second and third projections (17, 18, 19) comprise complementary threaded parts (18', 17', 19').

20. A case according to claim 19, characterized in that the threaded parts (18', 17', 19') are inclined with respect to a plane transverse to the principal axis (5) of the case, so as to cause, by rotation of the lid with respect to the base in the second direction (S') of rotation from the engagement position, a moving away of the lid (7) with respect to the base (2).

21. A case according to claim 10, characterized in that the complementary latching members (13, 14) comprise, as raised parts, a first stop (18", 18''') on the cylindrical wall (4) of the lid (7) and a second stop (17', 17") on the cylindrical wall (9) of the base (2), the stops (17', 17", 18", 18''') being such that, when they are in mutual engagement, they prevent a rotation of the lid (7) with respect to the base (2) in the second direction (S') of rotation with respect to the principal axis (5) of the case and an axial translation of the lid (7) moving said lid (7) away from the base (2).

22. A case according to claim 21, characterized in that the first stop (18", 18''') extends, in the reverse, direction to the second direction (S') of rotation, the end, upstream in the second direction (S') of rotation, of the first projection (18), and the second stop (17', 17") extends, in the reverse direction to the second direction (S') of rotation, the end, upstream in the second direction (S') of rotation, of the second projection (17).

23. A case according to claim 21, characterized in that the stop (18", 18''') comprises a section (18") situated substantially in a transverse plane with respect to the principal axis (5) of the case and, upstream of this section in the second direction (S') of rotation, a snub (18''') turned toward to the transverse wall (8, 3) of the lid (7).

24. A case according to claim 21, characterized in that the second top (17", 17''') comprises a wedge (17''') opposite to the second direction (S') of rotation and turned toward the base (2).

25. A case according to claim 24, characterized in that the second projection (17) is extended, in the second direction (S') of rotation, at its downstream end, by a ramp (17'''') guiding the snub in the reverse direction to the second direction (S') of rotation.

26. A case according to claim 17, characterized in that the third projection (19) is extended, in the reverse direction (S') to the second direction of rotation, by a section (19") situated substantially in a transverse plane with respect to the principal axis (5) of the case.

27. A case according to claim 17, characterized in that the first projection (18) and the first stop (18", 18''') are situated on the first cylindrical wall (9) of the lid (7), and the second and third projections (17, 19) and the second stop (17', 17", 17''') are situated on the first cylindrical wall (4) of the base (2).

28. A case according to claim 17, characterized in that the first projection (18) and the first stop (18", 18''') are situated on the first cylindrical wall (4) of the base (2), and the second and third projections (17, 19) and the second stop (17', 17", 17''') are situated on the first cylindrical wall (9) of the lid (7).

29. A case according to claim 2, characterized in that the complementary sealing members (21, **4*a*) issue from the respective walls (3, 4, 8, 9) of the lid and base, are directed along the principal axis (5) of the case, and are situated outside the compartment (6**).

30. A case according to claim 29, characterized in that the complementary sealing member (**4*a*) for the automatically mating lip (21) has an edge (4*e*) projecting towards the latter, along the principal axis (5**) of the case.

31. A case according to claim 30, characterized in that the automatically mating lip (21) and the edge (**4*a*) are such chat the lip (21) is applied to the internal side of the edge (4*a*), when the lid (7**) is in the latched closure position.

32. A case according to claim 30, characterized in that the automatically mating lip (21) and the edge (**4*a*) are such that the lip (21) is applied to the external side of the edge (4*a*), when the lid (7**) is in the latched closure position.

33. A case according to claim 30, characterized in that the automatically mating lip (21) and the edge (**4*a*) are such that the lip (21) is applied to the extreme side of the edge (4*a*), when the lid (7**) is in the latched closure position.

34. A case according to claim 29, characterized in that the side of the projecting edge (**4*a*) to which the automatically mating lip (21**) is applied is bevelled in the direction of the latter.

35. A case according to claim 31, characterized in that the projecting edge (**4*a*) comprises the edge of the cylindrical wall (4) of the base turned towards the lid and the lip (21) issues from a shoulder (20) on the lid (7), which is situated inside the compartment delimited by the transverse wall (8) of the lid (7) and its cylindrical wall (9) and which is such that said lid (7) is applied to the internal side of the projecting edge (4*a*), when the lid (7) is in the latched closure position, the first cylindrical wall (9) of the lid surrounding that (4**) of the base.

36. A case according to claim 2, characterized in that the automatically mating lip (21) is a moulded-on joint.

37. A case according to claim 2, characterized in that the automatically mating lip (21) is made from an elastic material.

38. A case according to claim 2, characterized in that the complementary sealing members (21, **4*a*) are formed by revolution with respect to the principal axis (5**) of the case.

39. A case according to claim 1, characterized in that the lid has an opening passing through its transverse wall (8) and a window made from a translucent material, which is immobilized in the opening.

40. A case according to claim 39, characterized in that the window is made from a transparent material.

41. A case according to claim 39, characterized in that the opening passing through the transverse wall (8) delimits a disc formed by revolution about the principal axis (5) of the case and the window has the shape of this disc.

42. A case according to claim 41, characterized in that the through opening extends substantially as far as the first cylindrical wall (9) of the lid and the window is contiguous with an annular shoulder extending over the circumference of the face of its disc, turned towards the base, the shoulder (20) being designed to receive the sealing member (21) for the lid, able to be compressed by the first cylindrical wall (4) of the base (2), the case being substantially sealed, with regard to the compartment in the base (2), in the latched closure position.

43. A case according to claim 2, characterized in that the automatically mating lip (21) issues from the shoulder of the window.

44. A case according to claim 1, characterized in that the base (2) has, on the side of its transverse wall (3) remote from its first cylindrical wall (4), walls delimiting a compartment intended to receive a make-up implement, notably a powder puff.

45. A case according to claim 3, characterized in that the members (17, 18, 19) for guiding in translation along the principal axis (5) of the case and the members for guiding in rotation about this axis are merged.

46. A case according to claim 19, characterized in that the guidance members comprise the complementary threaded parts (17', 18', 19').

47. Case according to claim 1, characterized in that the lid (7) has, issuing from the side of its transverse wall (8) remote from its first cylindrical wall (9), a second cylindrical wall (22), delimiting, with the transverse wall (8), a second compartment (23), notably for a cosmetic, and the case has a second lid (24) hinged on the base (2) and being able to be situated, when the first lid (7) is in the latched closure position, between two extreme positions, a second latched closure position, in which the base (2) and the second lid (24) are associated rigidly with each other opposite each other, the second lid (24) surrounding the second compartment, a second position of complete opening, in which the second lid (24) allows access to the second compartment.

48. Powder compact comprising a case (1) according to claim 1 and a cosmetic make-up with a predetermined non-liquid consistency placed in a compartment.

49. Method for the complete opening of a case, according to claim 1, from the latched closure position, characterized by the following successive phases:

a first phase at least of rotation of the lid (7) with respect to the base (2) about the principal axis (5), of the case, as far as the intermediate engagement position.

a second phase of pivoting of the lid (7) with respect to the base (2) about the second axis from the intermediate engagement position to the position of complete opening.

50. Method of closing a case, according to claim 1, from the complete opening position, characterized by the following successive steps:

a first step of pivoting the lid (7) with respect to the base (2) about the second axis, as far as the intermediate engagement position, a second step of rotation of the lid (7) with respect to the base (2) about the principal axis (5) of the case, from the intermediate engagement position to the latched closure position.

* * * * *